United States Patent [19]

Dreier

[11] Patent Number: 4,826,156

[45] Date of Patent: May 2, 1989

[54] EXERCISER

[76] Inventor: Beat Dreier, 63, rue de la Prulay, Meyrin, Switzerland

[21] Appl. No.: 146,136

[22] PCT Filed: Apr. 10, 1987

[86] PCT No.: PCT/CH87/00041

§ 371 Date: Dec. 23, 1987

§ 102(e) Date: Dec. 23, 1987

[87] PCT Pub. No.: WO87/06482

PCT Pub. Date: Nov. 5, 1987

[30] Foreign Application Priority Data

Apr. 24, 1986 [CH] Switzerland ..... 1659/86

[51] Int. Cl.[4] ..... A63B 21/00

[52] U.S. Cl. ..... 272/130; 188/322.18

[58] Field of Search ..... 272/130, 134, 137; 92/108; 188/311, 313, 322.18

[56] References Cited

U.S. PATENT DOCUMENTS

| | | | |
|---|---|---|---|
| 3,696,894 | 10/1972 | Brady et al. | 188/322.18 X |
| 4,290,600 | 9/1981 | Kobel | 272/130 X |
| 4,353,547 | 10/1982 | Jenkinson | 272/134 X |

FOREIGN PATENT DOCUMENTS

| | | | |
|---|---|---|---|
| 3020232 | 5/1981 | Fed. Rep. of Germany | 272/130 |
| 1599835 | 8/1970 | France | 272/130 |
| 2577812 | 8/1986 | France | 272/130 |
| 1112494 | 5/1968 | United Kingdom | 272/130 |

*Primary Examiner*—Richard J. Apley
*Assistant Examiner*—Robert W. Bahr
*Attorney, Agent, or Firm*—Silverman, Cass, Singer & Winburn, Ltd.

[57] ABSTRACT

The user of the exerciser acts on control members which are integral with a cylinder (6) moving in a vertical (8). A fixed tube (12) penetrates into the cylinder (6). A compressor (16) produces an overpressure inside the tube (12) and the cylinder (6). An antagonist force which is function of the value of said overpressure and of the cross-section surface of the tube (12) is opposed to the downward displacements of the cylinder (6). Said antagonist force is substantially constant, the volume of the portion of the tube (12) engaged in the housing (6) being negligible with respect to the total volume of the latter. Thus, contrary to exercisers of this type wherein the antagonist force is produced by a spring or by the displacement of a piston inside a cylinder, the force in question remains constant throughout the displacement of the moving member on which is acting the user of the exerciser.

5 Claims, 2 Drawing Sheets

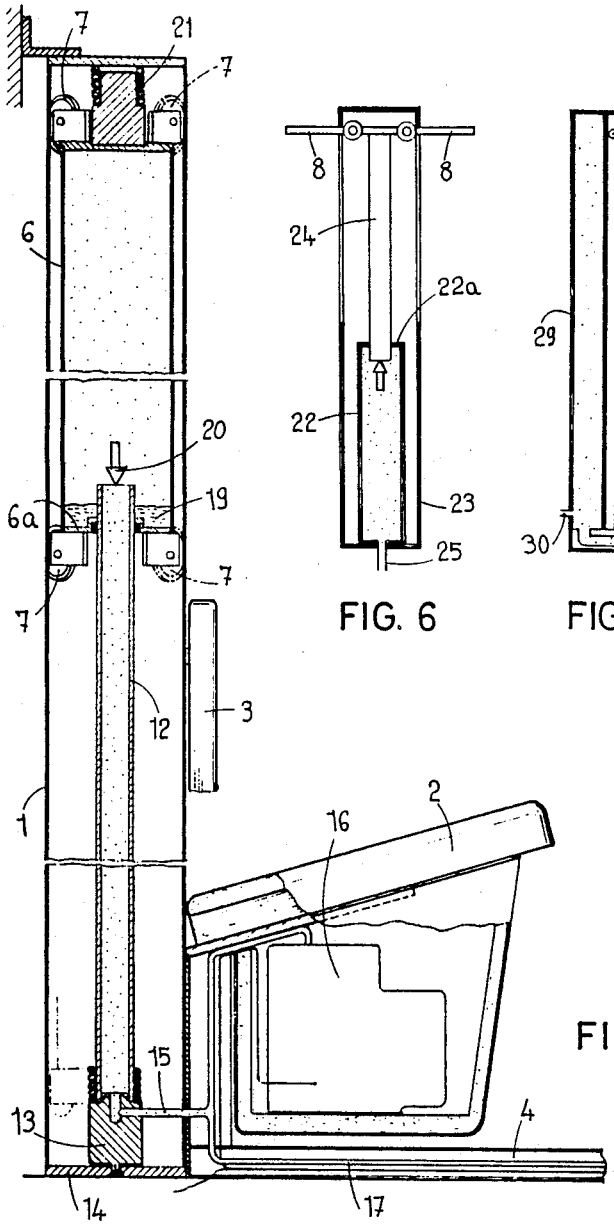
FIG. 5
FIG. 6
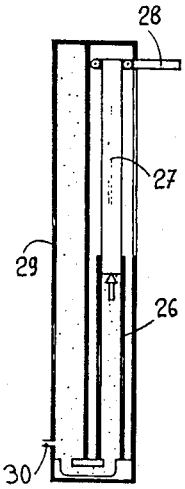
FIG. 7
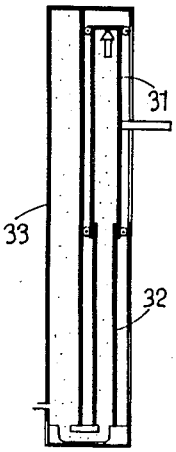
FIG. 8
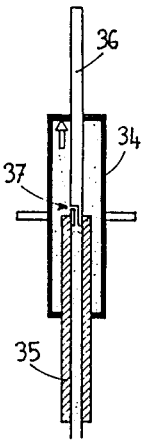
FIG. 9

EXERCISER

The present invention has for object an exerciser comprising at least one movable element on which acts the user for moving it against the action of an antagonistic force.

Such exercisers are known per se. In these apparatus, the antagonistic force which is opposed to the forces applied by the user is produced either by a spring or by a piston moving in a chamber and producing, by means of this movement, a compression of the air contained therein.

In the two cases, this antagonistic force is not constant and increases with the displacement of the movable member on which acts the user of the apparatus.

Now, such a variation of the antagonistic force against which acts the user of the apparatus is not always desirable, on the contrary. One has attempted to remove this drawback while realizing apparatus the antagonistic force of which is produced by counterweights, but this arrangement is not convenient and cumbersome.

The object of the present invention is to furnish an apparatus of the above mentioned type in which the antagonistic force against which acts the user of the apparatus remains substantially constant during the operation.

This object is reached owing to means defined in claim 1.

The drawing shows, by way of example, one embodiment of the object of the invention and modifications.

FIG. 5 is a sectional view on the line V—V of FIG. 4, to a larger scale, some portions being broken, and FIGS. 6 to 9 are sectional views of a detail of four modifications.

Figure 1:
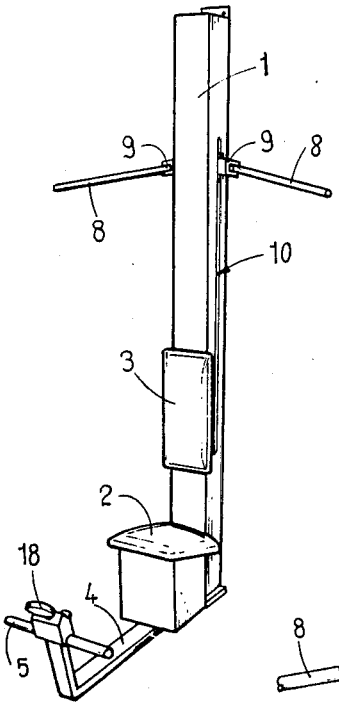
FIG. 1 is a perspective view of an exerciser.

The apparatus represented in FIGS. 1 to 5 comprises a vertical column 1, of square section, which can be secured to a wall, comprising, at its basis, a seat 2 on which is seated the user, and carrying, above this seat, a padded portion 3, constituting a back. The column 1 is mounted on a basis member 4, resting on the ground, provided with a transversal member 5 constituting a foot-rest.

Figure 4:
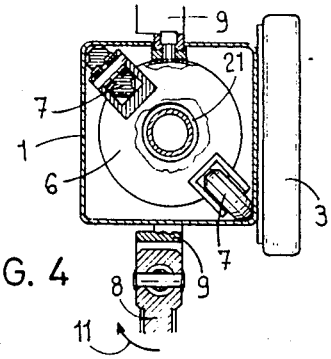
FIG. 4 is a sectional view on the broken line IV—IV of FIG. 3, to a larger scale.
Figure 2:
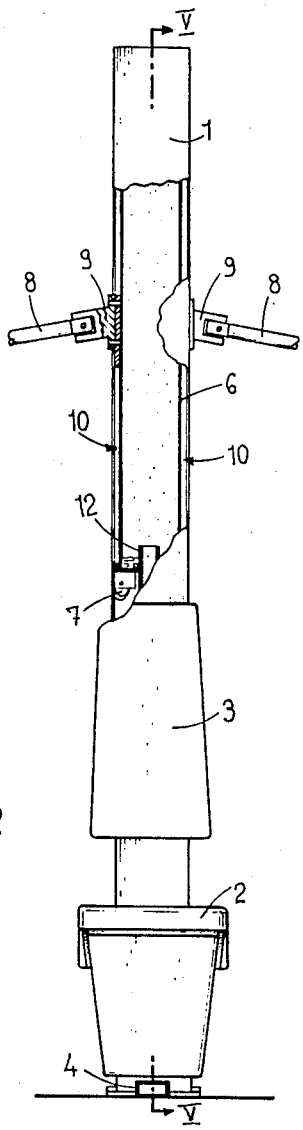
FIG. 2 is an elevational view, to a larger scale and with a sectional portion, of the apparatus according to FIG. 1.
Figure 3:
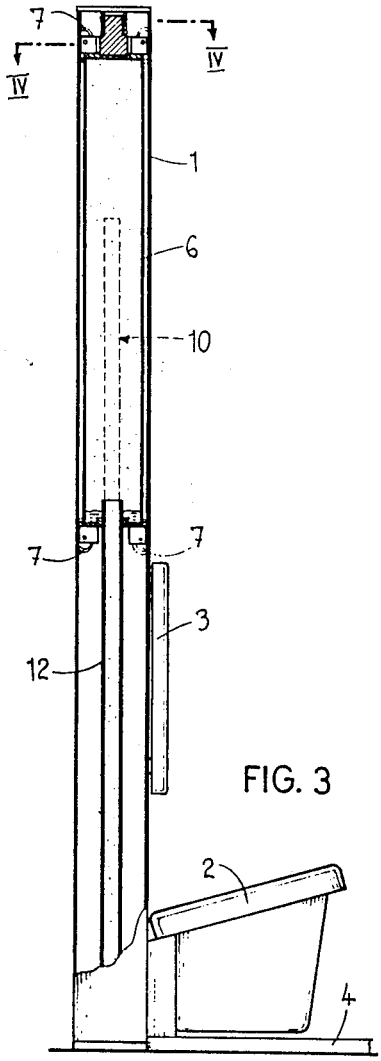
FIG. 3 is a lateral view thereof, with a partial section, to the scale of FIG. 2.

The apparatus comprises, moving in the column 1, a cylinder 6 provided with rollers 7 arranged diagonally, as specially shown in FIG. 4, guiding the cylinder 6 in its displacements in the column 1. This cylinder is rigid with two control arms 8 which are gripped by the user of the apparatus when it is seated on the seat 2 and that he moves downwardly. These two arms 8 are articulated on forks 9 which are themselves secured to the cylinder 6 and which moves themselves in slits 10 provided in the lateral walls of the column 1. The articulation of the arms 8 on the forks 9 is arranged in such a way as to permit the orientation of the arms 8 being adjustable on about 90° in the sense of the arrow 11 of FIG. 4, and being blockable in this position.

The basis 6a (FIG. 5) of the cylinder 6 is provided with an aperture through which passes a rectilinear tube

12 opening in the room provided by the cylinder 6, secured to a mounting member 13 itself secured to the bottom, designated by 14, of the column 1 and which is connected by a duct 15, to a compressor 16 located under the seat 2. This compressor permits to create in the tube 12 and the room 6 a pressure which is higher than the atmospheric pressure. A duct 17 passes through the basis 4 and ends to a manometer 18 (FIG. 1) situated above the rest-foots 5 which permits to the user of the apparatus to know the pressure reigning in the room 6. The tightness between the bottom 6a and the tube 12 is obtained by an annular gasket and by an oil bath 19 situated in the bottom of the room.

The pressure reigning in the room has for effect to oppose itself to the downwards displacements of the cylinder 6 by a force which is function on the one hand of the said pressure and on the other hand of the section of the tube 12. When the cylinder 6 is moved downwardly, the penetration of the tube 12 inside the room 6 produces only a very low increase of the pressure inside the room since the volume of the portion of the tube 12 engaged in the cylinder 6 is low with respect to the total volume under pressure.

Hence, the antagonistic force the user of the apparatus has to overcome when he acts on the arms 8 of the apparatus for displacing the cylinder 6 downwardly, indicated by the arrow 20 of FIG. 5, is substantially constant, increasing only neglictably during this displacement.

This antagonistic force is adjustable as the user wants it, since the user can vary the pressure reigning in the room 6.

When the user releases the control arms 8, the cylinder 6 goes up from itself, its stopping, in the upper position, being damped by a spring 21.

The modification of FIG. 6 distinguishes from the embodiment of FIGS. 1 to 5 by the fact that, in the latter, the cylindrical room, designated by 22, is stationary in the column, designated by 23, of the apparatus, the control arms being rigid with a bar 24 which passes through the upper axial face, designated by 22a, of the room 22 and penetrating into the latter. The bar 24 can be full or hollow, the total volume under pressure being, in the latter case, increased, that has for advantage of reducing the slight increase of the pressure when the bar 24 is moved downwardly by the user of the apparatus.

It is to be noted that the cylinder 22 is provided, at its basis, with a pipe 25 intended to connect it to a compressor.

The modification of FIG. 7 distinguishes from this of FIG. 6 by the fact that, in order to still increase the volume under pressure, the cylindrical room, designated by 26, in which moves the vertical bar 27 submitted to the action of a control member 28, is in communication with a second room, designated by 29, provided with a pipe 30 intended to be connected to a compressor. Hence, the antagonistic force remains substantially constant, by reason of the increase of the volume under pressure, even when, in this case, the cross section of the bar 27 corresponds substantially to this of the cylinder 26.

The modification of FIG. 8 is similar to this of FIG. 7 with the difference it is not the bar diving in the cylinder which is movable, but the cylinder, designated by 31, which slides on the bar, designated by 32, which is hollow. In this modification, the hollow bar 32 is in communication with a second room, designated by 33, corresponding to the room 29 of FIG. 7.

At last, in the modification of FIG. 9, the cylinder room, designated by 34, is traversed by an elongated member comprising on the one hand a hollow portion 35 and on the other hand a full stem 36, a passage 37 making the inner duct of the hollow portion 35 to communicate with the inner of the room 34. The antagonistic force opposing itself to the displacement of the cylinder 34 downwardly is function on the one hand of the pressure inside this cylinder and on the other hand of the difference between the cross sections of the portions 35 and 36 of the member traversing the cylinder 34.

As a modification, the cylinder 34 could be secured to the movable member 35–36.

It is to be noted that the compressor may be replaced by a bottle of gas under pressure or by a foot pump.

I claim:

1. An exerciser comprising:

chamber having at least one aperture and being positioned within a hollow guiding column in which said chamber is axially movable, said column indicating means for supporting said chamber with respect to said column as said chamber is moved axially within said column;

means for providing pressure within said chamber higher than the atmospheric pressure, said means for providing pressure being variable; and a rod fitted in sealed engagement with said aperture, said rod being so constructed and arranged that it is capable of being inserted within said chamber through said aperture against the force of said pressure so that the difference between the inner volume of said chamber before and after insertion of said rod is negligible and said rod can be inserted within said chamber with a constant force during the entire insertion of said rod into said chamber.

2. The exerciser as claimed in claim 1, wherein said means for supporting said chamber includes a plurality of rollers provided along an outer surface of said chamber for engagement along an inner face of a wall of said column.

3. An exerciser comprising;

a chamber having at least one aperture;

means for providing pressure within said chamber higher than the atmospheric pressure, said means for providing pressure being variable;

a rod fitted in sealed engagement with said aperture, said rod being so constructed and arranged that it is capable of being inserted within said chamber through said aperture against the force of said pressure so that the difference between the inner volume of said chamber before and after insertion of said rod is negligible and said rod can be inserted within said chamber with a constant force during the entire insertion of said rod into said chamber; and said rod being positioned within a hollow guiding column in which said rod is axially movable, said column including means for supporting said rod with respect to said column as said rod is moved axially within said column, said means for supporting said rod including a plurality of rollers provided along an outer surface of said rod for engagement along an inner face of a wall of said column.

4. Exerciser comprising at least one movable member on which acts the user for displacing it against the action of an antagonistic force, said force being produced by means of a device in operable communication with said movable member comprising a cylindrical chamber positioned within a hollow guiding column in which said chamber is axially movable along a plurality of rollers provided along an outer surface of said chamber for engagement along an inner face of a wall of said column, said chamber having a pressure higher than the atmospheric pressure that is produced by means for providing pressure, a circular base of said chamber being provided with an opening traversed and fitted with a rod that is in sealed engagement with said opening, the diameter of said opening corresponding to the diameter of said rod and being a sub-multiple of the diameter of said chamber, said rod and said chamber being able to move with respect to each other in such a way that said rod enters inside said chamber, against the pressure exerted on said rod, the difference between the inner volume of said chamber before and after the penetration of said rod being negligible so that the pressure exerted on said rod remains substantially constant during the whole penetration of said rod into said chamber.

5. Exerciser as claimed in claim 4, characterized by the fact that said rod is hollow, the inner volume of said rod being added to the inner volume of said chamber in such a way to further reduce the difference between the inner volumes of said chamber before and after the penetration of said rod therein.

* * * * *